US007527013B2

(12) United States Patent
Bramson

(10) Patent No.: US 7,527,013 B2
(45) Date of Patent: May 5, 2009

(54) MULTI-FUNCTION WATERCRAFT PORTAGE DEVICE

(76) Inventor: David Bramson, P.O. Box 284, Marengo, IL (US) 60152

( * ) Notice: Subject to any disclaimer, the term of this patent is extended or adjusted under 35 U.S.C. 154(b) by 0 days.

(21) Appl. No.: 11/820,435

(22) Filed: Jun. 19, 2007

(65) Prior Publication Data

US 2008/0314307 A1 Dec. 25, 2008

(51) Int. Cl.
*B63B 21/64* (2006.01)

(52) U.S. Cl. ..... 114/344; 280/414.1

(58) Field of Classification Search ..... 114/344; 280/47.131, 47.331, 414.1, 414.2
See application file for complete search history.

(56) References Cited

U.S. PATENT DOCUMENTS

| | | | | |
|---|---|---|---|---|
| 2,929,079 | A | 3/1960 | Totten | |
| 3,119,127 | A * | 1/1964 | Taggert | 114/344 |
| 4,830,387 | A * | 5/1989 | Batten | 280/47.331 |
| 5,197,405 | A | 3/1993 | King | |
| 5,740,755 | A | 4/1998 | Nichols, Jr. | |
| 5,975,003 | A * | 11/1999 | Manson | 114/344 |
| 6,032,964 | A | 3/2000 | Capobianco | |
| 6,142,492 | A | 11/2000 | DeLucia | |
| 6,189,478 | B1 | 2/2001 | Myers | |
| 6,305,306 | B1 | 10/2001 | Grzybowski | |
| 6,364,336 | B1 | 4/2002 | Jenkins | |
| 6,446,570 | B1 | 9/2002 | Johnson | |
| 6,926,292 | B1 | 8/2005 | Weeks | |
| 7,146,924 | B1 | 12/2006 | Vopal | |

FOREIGN PATENT DOCUMENTS

| | | | |
|---|---|---|---|
| EP | 0883999 | A | 12/1998 |
| MX | 9409276 | A | 5/1996 |
| WO | WO-0187076 | A | 11/2001 |
| WO | WO-2004008879 | A | 1/2004 |
| WO | WO-2004023892 | A | 3/2004 |

* cited by examiner

*Primary Examiner*—Lars A Olson
(74) *Attorney, Agent, or Firm*—Sean S. Swidler; IpHorgan Ltd.

(57) ABSTRACT

An assembly for transporting a watercraft, wherein the assembly remains coupled to the watercraft during transport of the craft and during operation of the craft. The assembly is rotatably adjustable through a range of positions including a transport position, a plurality of stabilizing positions, a stowing position, and an emergency position wherein the watercraft may be used as a shelter, wherein each of these positions may be easily locked into place by the operator of the watercraft. The assembly is further adjustable to accommodate watercraft of various widths.

19 Claims, 15 Drawing Sheets

MULTI-FUNCTION WATERCRAFT PORTAGE DEVICE

FIELD OF THE INVENTION

The present invention relates to a multi-positional, multi-purpose portage device for transportation of watercraft over land, for launching watercraft in water, for stabilizing watercraft during use and for recovering watercraft from water.

BACKGROUND OF THE INVENTION

While a number of prior art watercraft portage devices have been proposed to effectively transport small boats and watercraft to and from the water's edge, each of these devices, while having served a particular purpose have also exhibited a number of drawbacks. U.S. Pat. No. 5,197,405 describes a boat-attached wheel system that positions both wheels as a single unit and stows them behind the transom, with no flexibility in choosing wheel position independently. This causes interference with transom-mounted motors and other apparatus such as "ski ropes".

U.S. Pat. No. 3,499,177 shows a boat-attached wheel system requiring that the boat be inverted to roll the boat on land or into the water. Since the boat cannot operate inverted in the water, it requires that the boat be inverted prior to water entry. This requires lifting or rolling the boat to an upright position, and carrying or sliding the boat into the water instead of simply rolling the boat into the water such as the present invention.

U.S. Pat. No. 5,261,680 shows a boat-attached wheel system that is not adjustable. It only fits one boat width, is not adjustable longitudinally to compensate for longitudinal changes in boat loading, does not have the ability to retract the wheel assemblies into horizontal or vertical positions, and requires storage of wheels inside the boat where they take up passenger space and may get the passenger(s) wet.

U.S. Pat. No. 4,515,102 shows a wheel-axle arrangement with a single operating position along the longitudinal axis of the host boat, due primarily to inflexible or permanent mounting. When a boat is unloaded or loaded from one end, the center of mass moves along its length. While supporting the boat on its wheels, the operator must bear a portion of the weight of the boat and contents, which is proportional to the distance between the boat's center of mass and the axle position of the wheel assemblies.

SUMMARY OF THE INVENTION

The present invention comprises a portage device for a watercraft, wherein the watercraft comprises a first and second sidewall, each sidewall terminating at a gunwale having a top, inside and outside portion; a bottom section; a first width extending from the first to the second sidewall; a longitudinal axis extending through the length of the watercraft and a transverse axis perpendicular to the longitudinal axis and substantially parallel to the first width. The portage device comprises: (a) an adjustable transverse frame member having a first end extending to and associated with the first sidewall and a second end extending to and associated with the second sidewall; (b) a first gunwale clamp assembly operatively connected to the first end of the transverse frame member and the first sidewall; (c) a first locking assembly interconnecting the first end of the transverse frame and a first leg assembly, the first leg assembly selectively rotatable through a range of positions about a locking axis substantially parallel to the longitudinal axis, the range comprising a transport position, a stabilizing position and a stowing position; and (d) a wheel releasably attached to the first arm segment. In a preferred embodiment of the present invention, the portage device may also comprise a second locking assembly interconnecting the second end of the transverse frame and a second leg assembly.

The first locking assembly comprises: (a) a first bore and a second bore, each disposed on the first end of the transverse frame, each orientated substantially parallel to the locking axis; (b) a locking disc coupled to a first leg and comprising a central bore and a plurality of locking bores disposed around the circumference of the locking disc; (c) an axle configured to be received by the central bore of the locking disc and the first bore of the transverse frame to align the locking disc and first end of the transverse frame, and a first clip to secure the axle in position; and (d) a pin configured to be received by one of the plurality of locking bores to selectively align and secure the first leg with the first end of the transverse frame, and a second clip to secure the pin in position.

The first gunwale clamp assembly comprises: (a) a top plate extending over and around the top and outside segments of the gunwale; (b) an inside plate for engaging the inside of the gunwale; (c) a bore on the top plate aligned with a slot on the inside plate, the bore and slot configured to receive a fastener to secure the top plate and inside plate together and to the gunwale, wherein the slot enables the inside plate to selectively engage the inside portion of the gunwale at a plurality of positions. The gunwale clamp comprises a seat member configured to receive a fastener that extends from the seat member away from the top segment of the gunwale and towards the transverse frame, wherein securing the first gunwale clamp to the transverse frame member causes the fastener to be displaced away from the top segment of the gunwale. The fastener comprises a bolt having a geometrically shaped head and wherein the seat member has a corresponding shape to securely seat the bolt head therein and restrict axial rotation of the fastener.

DETAILED DESCRIPTION OF THE DRAWINGS

Figure 1:
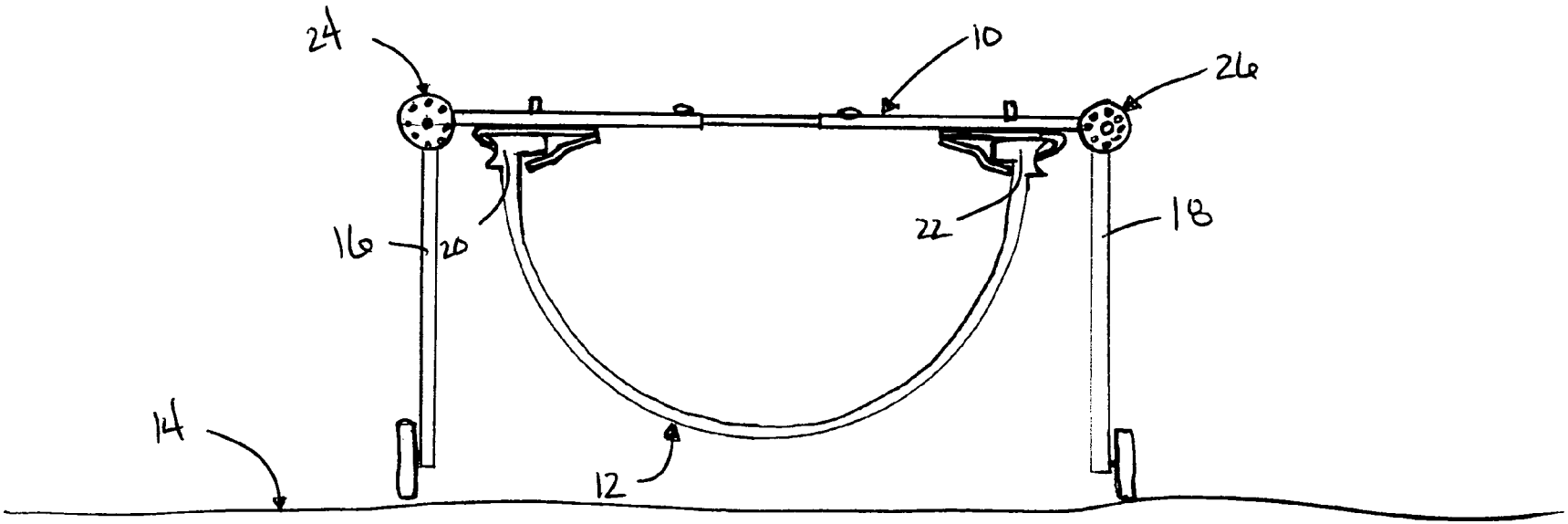
FIG. 1 shows a partial front elevation cut away view of the inventive portage device attached to a watercraft, the portage device in a first position.

The present inventive portage device 10 is shown herein in FIGS. 1 to 22. FIGS. 1-5 show the inventive portage device 10 attached to a watercraft 12, the inventive portage device 10 configured in various positions throughout the figures. FIGS. 6 to 22 show the various components of the inventive portage device 10 described herein. As is shown in the various figures, the inventive portage device 10 comprises a telescoping adjustable thwart assembly 34, a rotatable leg assembly operatively coupled to opposing ends of the telescoping adjustable thwart 34, and a gunwale clamp assembly 72*a, b* associated with opposite ends of the telescoping adjustable thwart 34. At the end of each rotatable leg assembly 24, 26 is a locking assembly configured to secure each leg 16, 18 is a selected position with respect to the thwart 34.

Figure 22:
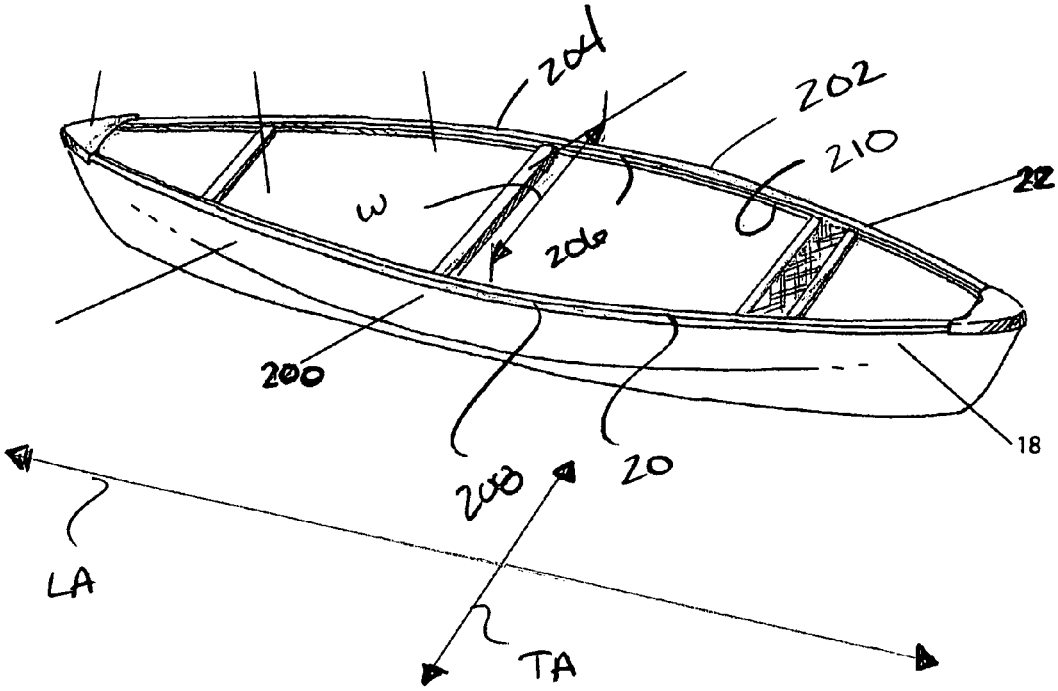
FIG. 22 shows a watercraft onto which the inventive portage device may be coupled.

Turning first to FIG. 1, the portage device 10 is mounted to the watercraft 12 in a first, "upright" position wherein the legs 16, 18 extend downwardly from the gunwale sections 20, 22 of the watercraft 12 towards the ground 14. As is seen in FIG. 22, it is contemplated that for a first preferred embodiment of the present invention, the watercraft 12 comprises a first and second sidewall 200, 202, each sidewall terminating at a gunwale 20, 22 having a top 204, inside 206 and outside 208 portion, a bottom section 210, a first width W extending from the first to the second sidewall 200, 202, a longitudinal axis LA extending through the length of the watercraft and a transverse axis TA perpendicular to the longitudinal axis and substantially parallel to the first width W, The legs 16, 18 are locked in a downward position at locking assemblies 24, 26. The watercraft 12 can also be operated when the portage device 10 is mounted in this first position. The wheels 30, 32 rotatably and releasably mounted at the ends of the arms 16, 18 act to stabilize the watercraft 12 during operation when the arms 16, 18 in this first position.

Figure 2:
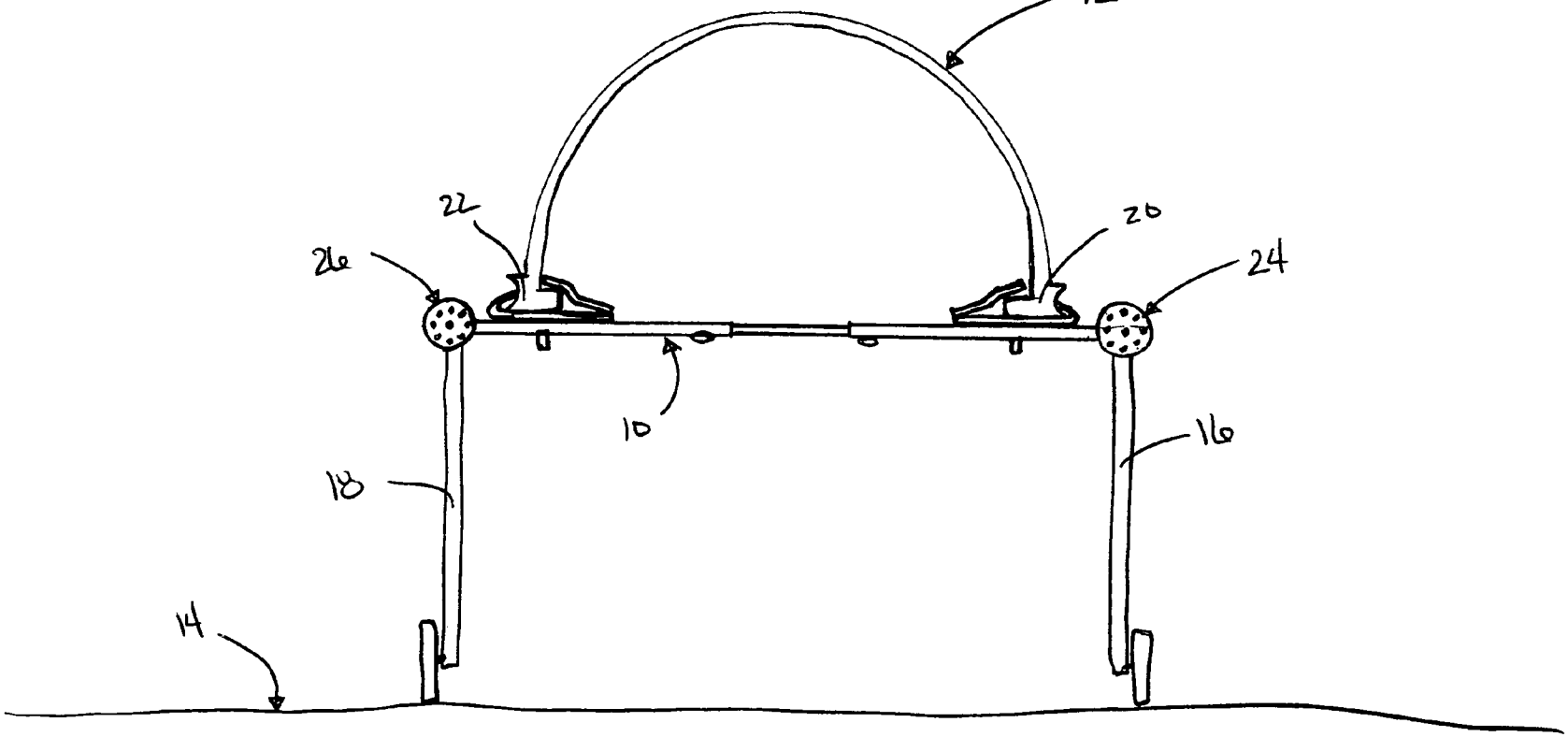
FIG. 2 shows a partial front elevation cut away view of the inventive portage device attached to a watercraft, the portage device in a second position.

FIG. 2 shows the portage device 10 in a second configuration referred to as the "turtle" position wherein the arms 16, 18 extend upwards from the gunwale sections 20, 22 of the watercraft 12. The turtle position is beneficial in situations where the terrain over which the watercraft 12 is being transported is uneven or rocky and additional clearance between the bottom of the watercraft 12 and the grounds 14 is required for smooth passage. The turtle position is also beneficial when the watercraft 12 is to be used as a shelter on its own or to support a sheet in a tent-like manner.

Figure 3:
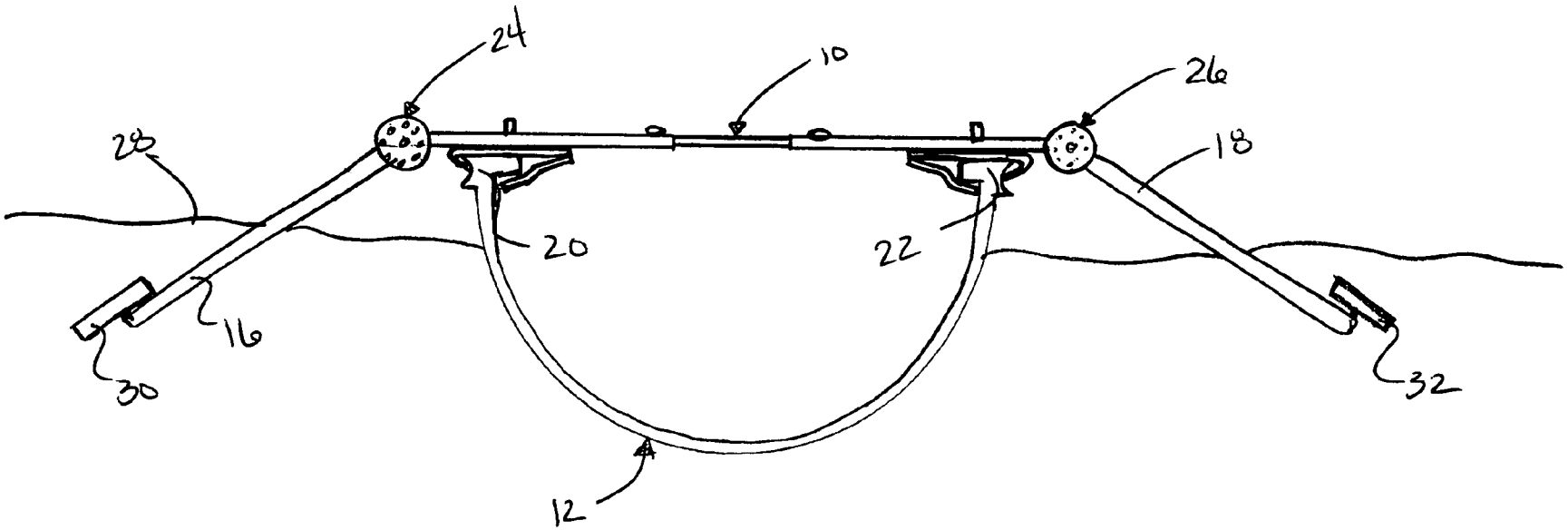
FIG. 3 shows a partial front elevation cut away view of the inventive portage device attached to a watercraft, the portage device in a third position.

Turning to FIG. 3, the inventive portage device 10 is shown attached to the watercraft 12 while the watercraft is in the water 28. The portage device 10 in this figures is shown in a second stabilizing position in which the legs 16, 18 are rotated at the locking assemblies 24, 26 from the first position shown in FIG. 1. The ends of the legs 16, 18 and wheels 30, 32 remain fully or partially submerged in the water 28 to provide stability to the watercraft 12 during operation. While FIG. 3 shows a specific configuration of the inventive portage device 10, the locking assemblies 24, 26 provide for multiple in-the-water stabilizing positions to accommodate watercraft operators of any weight or skill level, making the watercraft virtually impossible to capsize.

Figure 4:
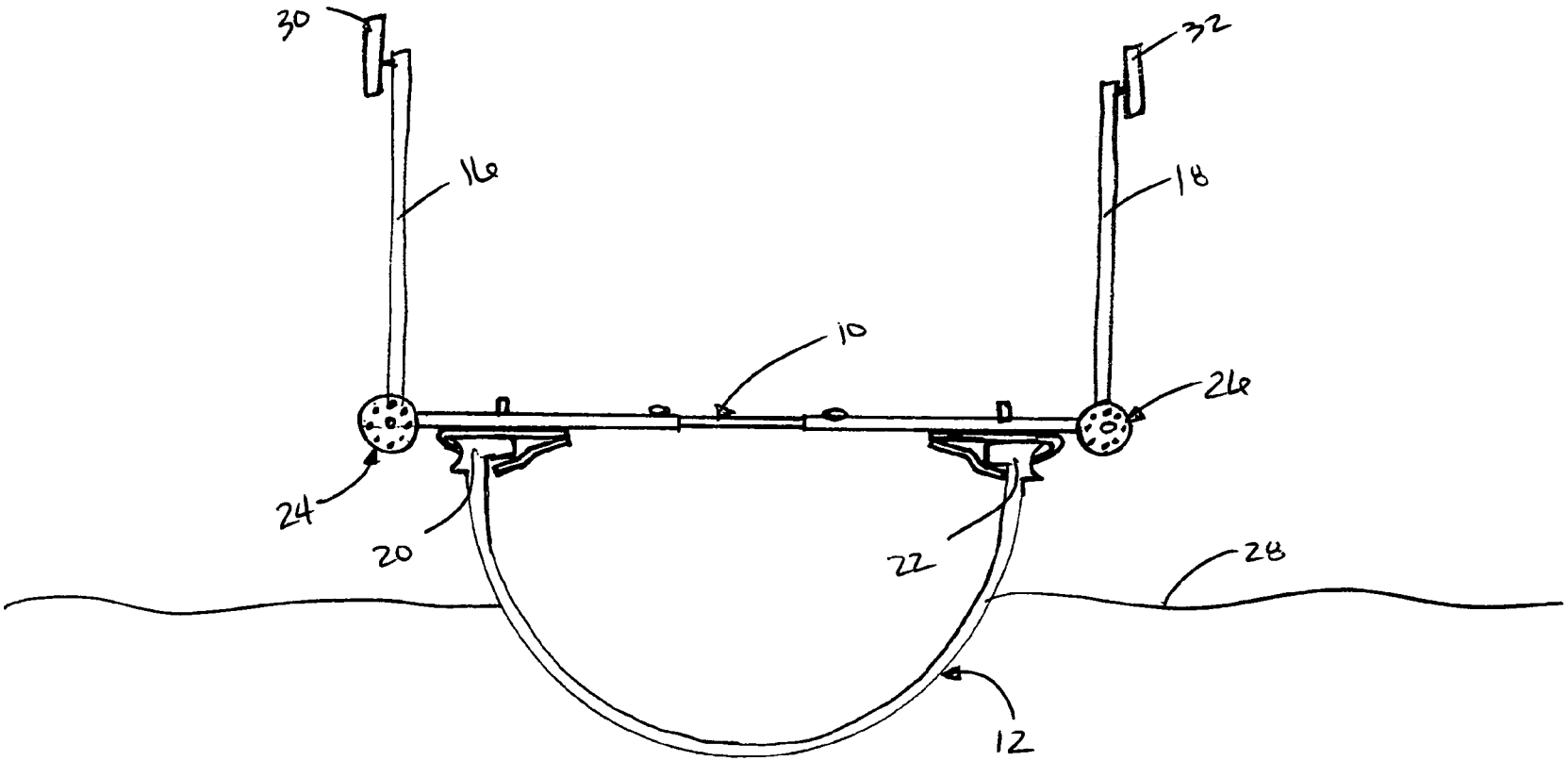
FIG. 4 shows a partial front elevation cut away view of the inventive portage device attached to a watercraft, the portage device in a fourth position.
Figure 5:
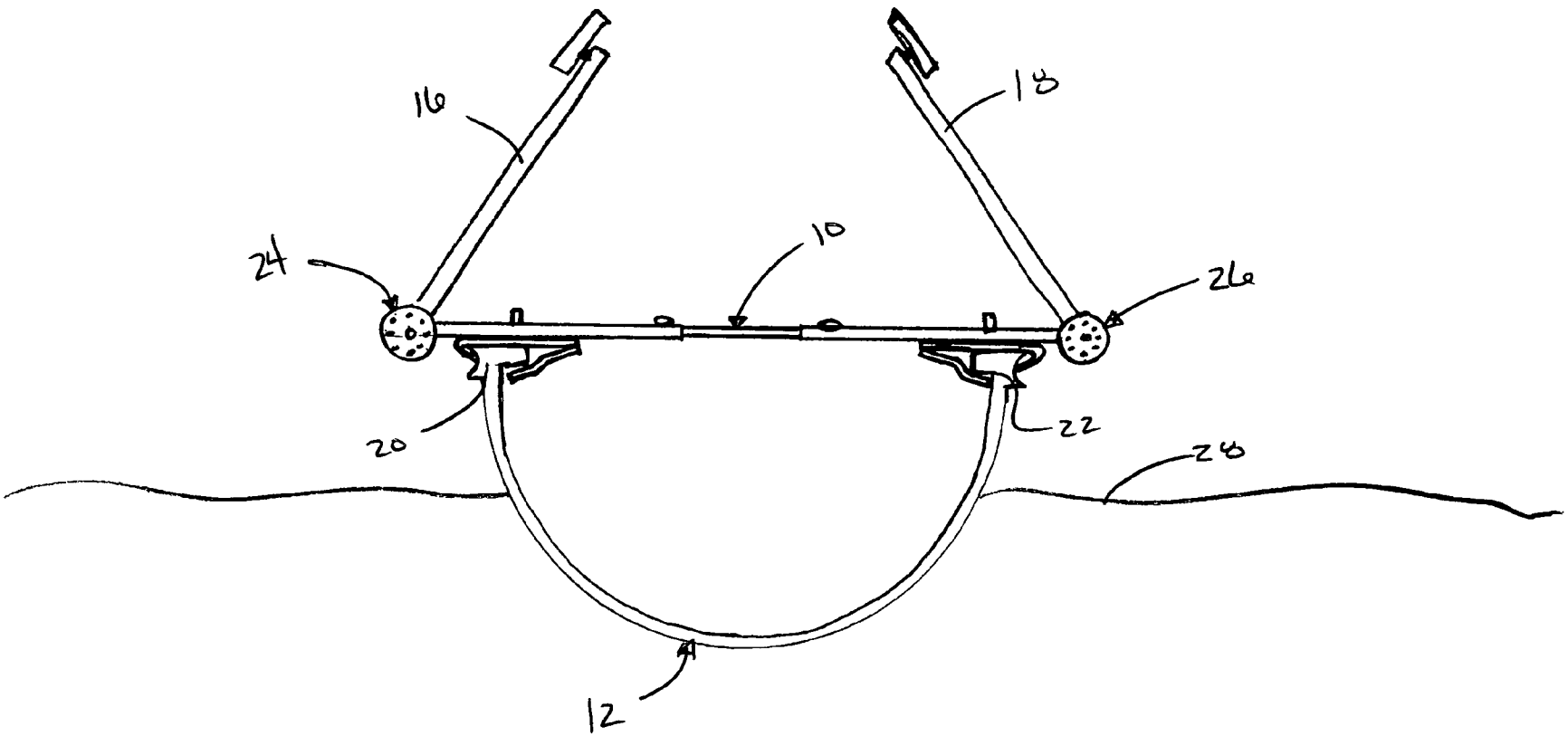
FIG. 5 shows a partial front elevation cut away view of the inventive portage device attached to a watercraft, the portage device in a fifth position.
Figure 6:
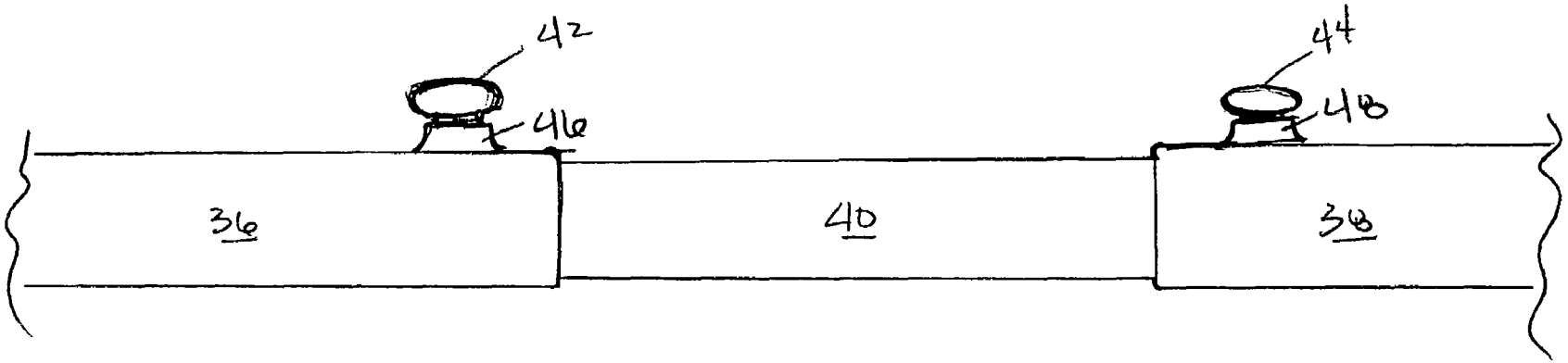
FIG. 6 shows a partial side elevation view of a component of the inventive portage device.

FIG. 4 shows the inventive portage device 10 in which the legs 16, 18 are rotated at the locking assemblies 24, 26 such that the legs 16, 18 are substantially perpendicular to the surface of the water 28. This position is the same as the "turtle" position, described in FIG. 2, but where the watercraft 12 is use, rather than being transported by the user. In this configuration, the overall width the watercraft 12 and portage device 10 are minimized, enabling passage of the watercraft 12 through narrow sections of waterways. At the same time, the legs 16, 18 and wheels 30, 32 intrude minimally into the space within the watercraft 12 that is used for passengers and/or gear. FIG. 5 shows yet another configuration of the inventive portage device 10 in which the legs 16, 18 are fully rotates about the locking assemblies 24, 26 to be rotated within the width of the watercraft 12. In this configuration, the legs 16, 18 are rotated substantially 270 degrees from the transverse axis TA (FIG. 22).

Figure 23:
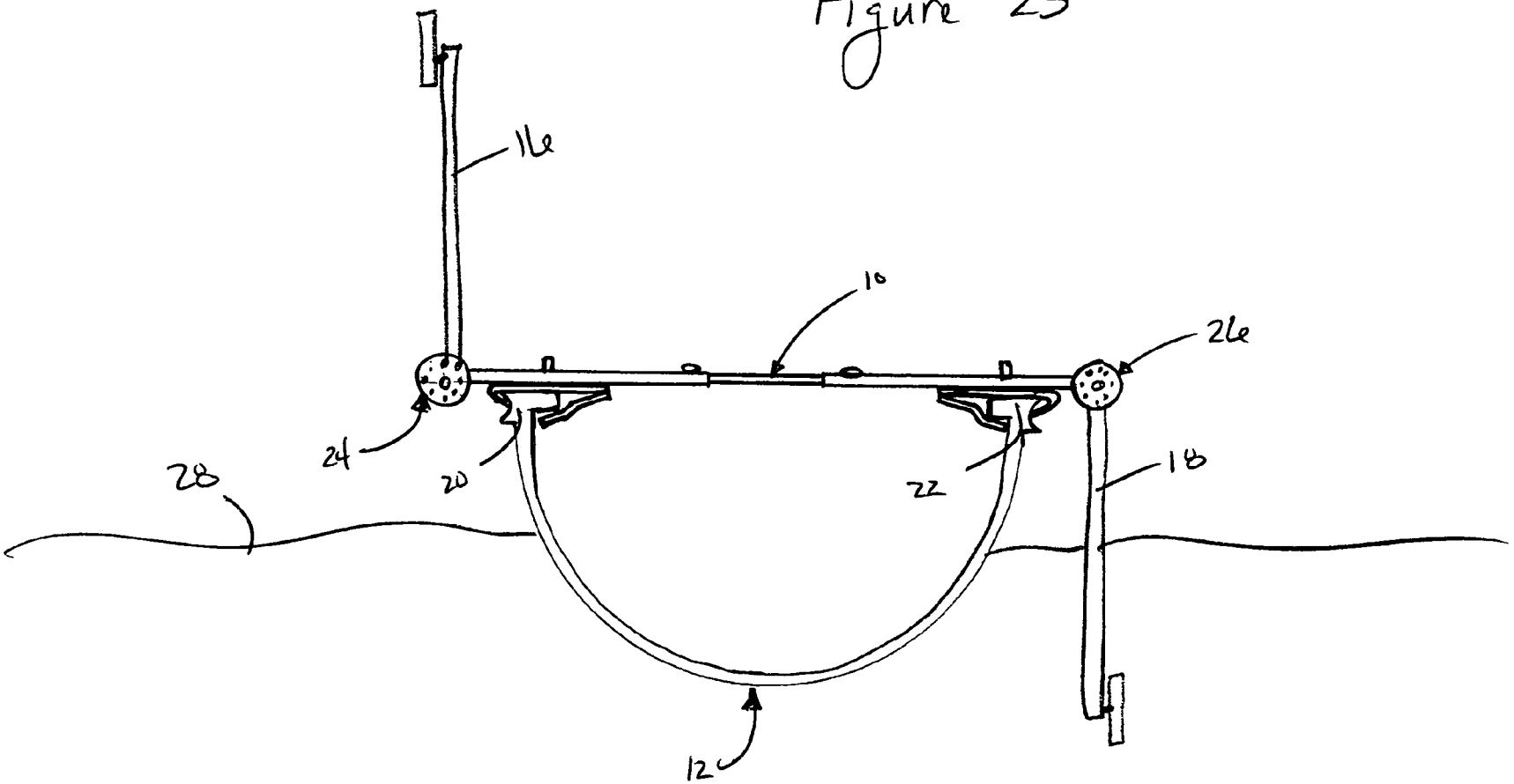
FIG. 23 shows a partial front elevation cut away view of the inventive portage device attached to a watercraft, the portage device in an alternative position.

FIG. 23 shows yet another alternative configuration in which the first leg 16 is rotated at the locking assembly 24 in an upwards direction and acts as mast. In an emergency situation, a shirt or sheet or other suitable article can be attached to the mast to act as a sail to propel the watercraft 12. The second arm 18 is rotated at the locking assembly 26 in a downwards direction and acts as a keel to stabilize the watercraft 12.

FIGS. 6-21 show the mechanical components of the inventive portage device 10. Turning first to FIGS. 1, 6-9 and 22, the portage device 10 comprises an adjustable transverse frame member comprising telescoping adjustable thwart 34 that enables the portage device 10 to be adapted for use on watercraft having a variety of different widths. The telescoping adjustable thwart 34 is coupled to the watercraft 12 with a first and second gunwale clamp assembly 72*a, b* that engages the gunwales 20, 22 of the watercraft 12. The legs 16, 18 are rotatably and releasably coupled to the telescoping adjustable thwart 34 at the locking assemblies 24, 26.

The thwart 34 comprises a first and second receiving arm 36, 38 and a cross member 40 that adjustably extends between the receiving arms 36, 38 in a telescoping manner. Fasteners 42, 44, which preferably comprise thumbscrews, are tightened to the hold the cross member 40 in a desired position between the receiving arms 36, 38. Each of the receiving arms comprises a threaded housing 46, 48 each having an aperture 50 for receiving the fasteners 42, 44. It is contemplated that the receiving arms 36, 38 are tubular in nature having a squared, circular or other geometrically configured cross-section. It is contemplated that the cross member 40 has cross-section that is complementary to that of the receiving arms 36, 38.

Figure 7:
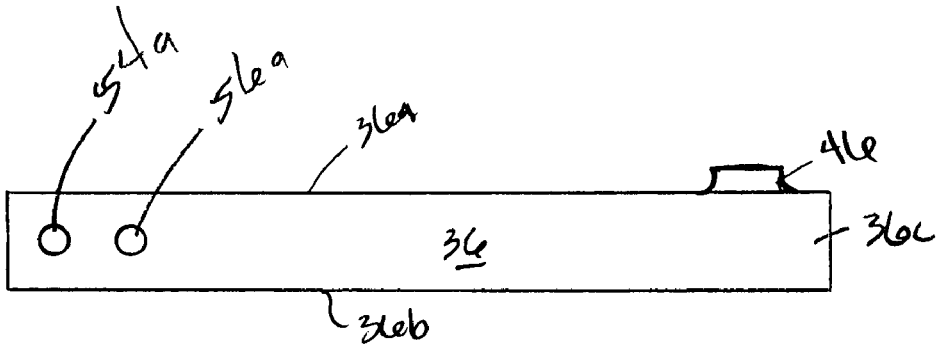
FIG. 7 shows a side elevation view of a component of the inventive portage device.
Figure 8:
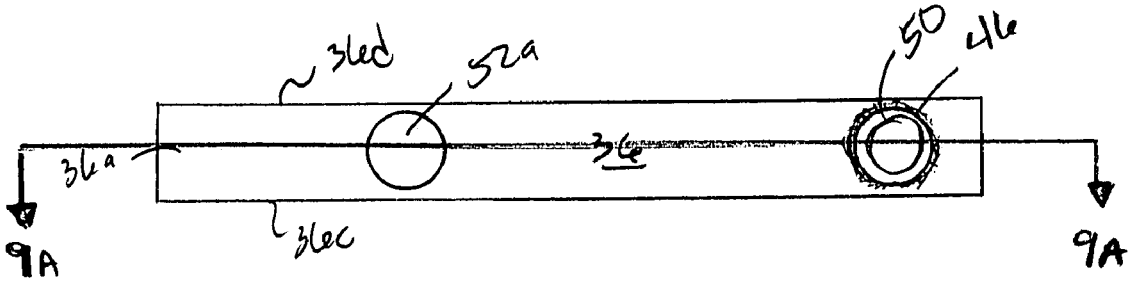
FIG. 8 shows a top elevation view of a component of the inventive portage device.
Figure 9:
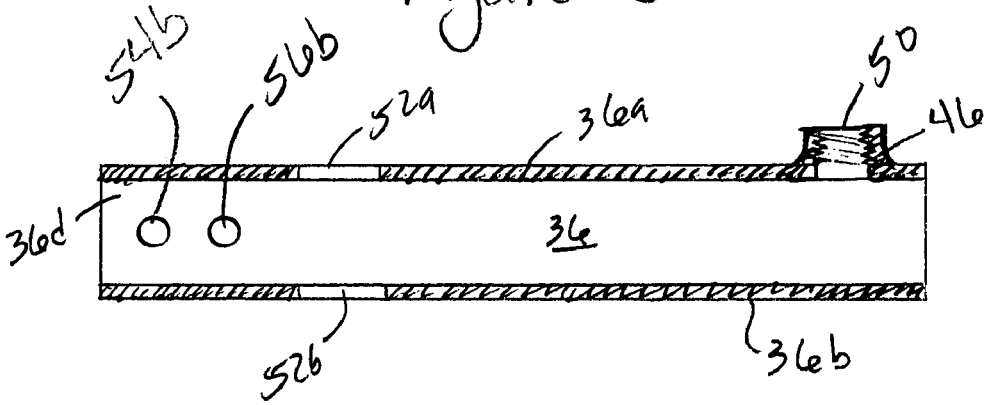
FIG. 9 shows a cutaway side elevation view of a component of the inventive portage device taken along line 9A-9A in FIG. 8.

FIGS. 7-9 show the receiving arm 36 (or 38) in greater detail. In the preferred embodiment of the present invention in which the receiving arm 36 has the square cross-section, the receiving arm comprises a top surface 36*a*, a bottom surface 36*b*, and a first and second side surface 36*c, d*. As previously discussed, a threaded housing 46 and aperture 50 are disposed on the top surface 36*a*. Concentrically aligned bores 52*a, b* are disposed on the top and bottom surfaces 36*a, b* of the receiving arm 36 at the end opposite the housing 46. The bores 52*a, b* receive a fastener for releasably connecting the gunwale clamp assembly to the receiving arm 36, as is discussed in greater detail supra. A first and second set of concentrically aligned throughholes 54*a, b*, 56*a, b* are disposed on the first and second side surfaces 36*c, d* of the receiving arm. The throughholes 54*a, b*, 56*a, b* receive fasteners as part of the variably locking rotation assembly 24 (FIG. 1).

Figure 12:
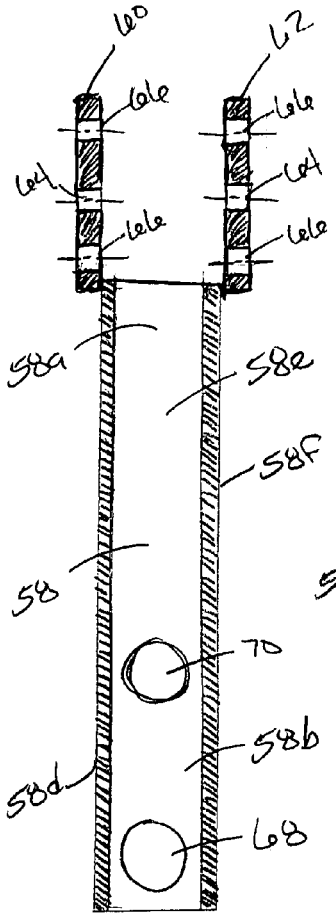
FIG. 12 shows a cutaway side elevation view of a component of the inventive portage device taken along line 12A-12A in FIG. 10.
Figure 10:
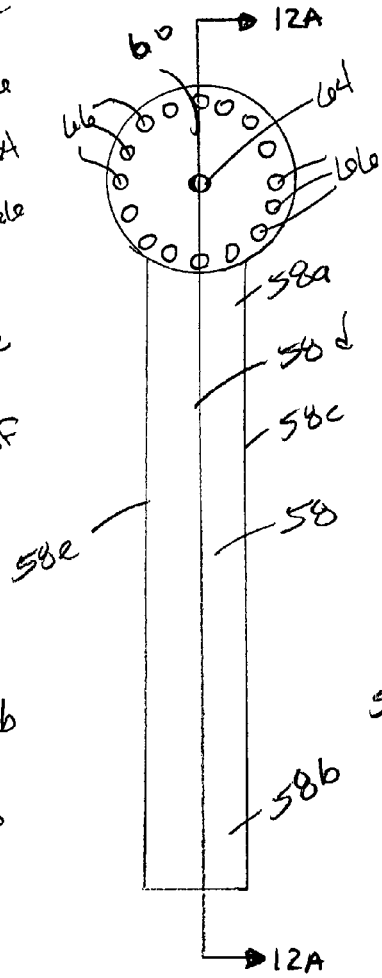
FIGS. 10-11 show side elevation views of a component of the inventive portage device.
Figure 11:
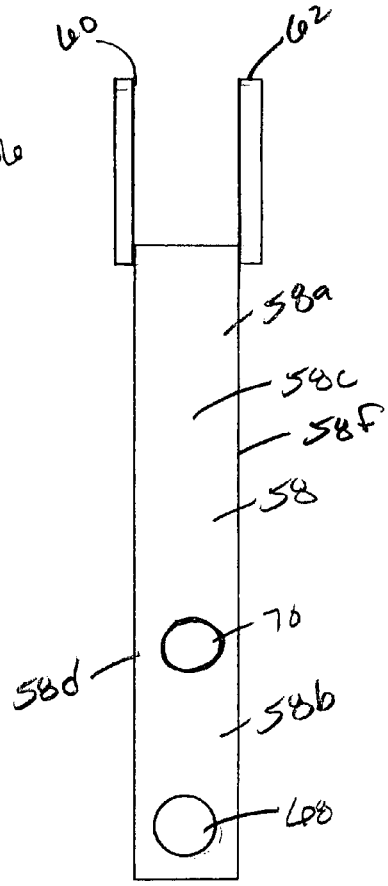
Figure 13:
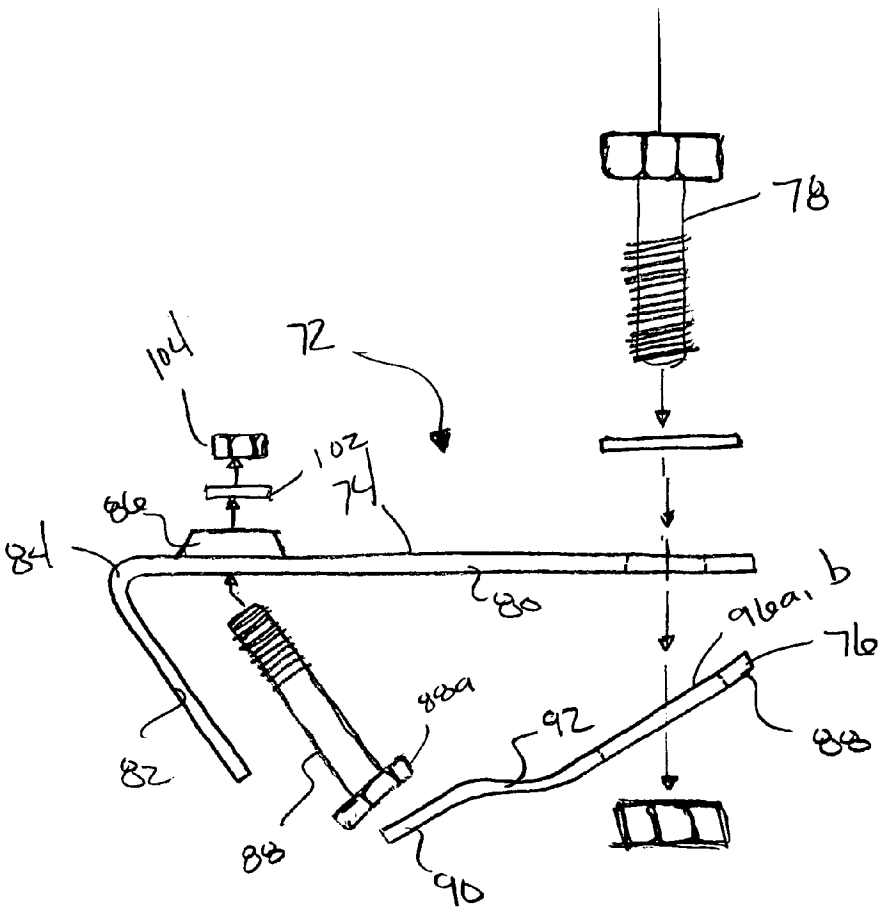
FIG. 13 shows an exploded view of an assembly of components of the inventive portage.

FIGS. 10-12 show the rotatable leg assemblies of FIGS. 1-5 in greater detail. Each leg 14, 16 comprises a shaft member 58, preferably square or square tubular in cross section, each shaft member having an upper and lower portion 58*a, b* and first, second, third and fourth side surface 58*c, d, e, f*. Concentric locking disks 60, 62 are mounted on the first and third side surfaces 58*d, f* of the shaft at the upper end 58*a* of the shaft. Each locking disk 60, 62 comprises a central bore 64 and plurality of peripheral bores 66. The central bore 64 and peripheral bores 66 are spaced apart the same distance as the throughholes 54, 56 (FIG. 7) in the receiving arm 36. Accordingly, when the central bore 64 is aligned and rotatably interconnected with the throughhole 54 by an axle or pin, the peripheral bores 66 will align with the throughholes 56 as the disk 60 is rotated about the axle or pin. Inserting a second axle or pin into the concentrically aligned peripheral bore 66 and throughhole 56 will lock the disk 60, and the shaft 58 in place. The peripheral bores 66 are displaced from edge of the disk 60 a distance sufficient to provide enough surface area on the disk to form a stable bond with the shaft, either by welding or suitable chemical bonding agent.

The lower end 58*b* of the shaft are disposed a first and second throughhole 68, 70. The first throughhole 68 extends from the first surface 58*c* to the third surface 58*e* of the shaft. The first throughhole 68 is configured to receive a pin or axle onto which a wheel 30 (FIG. 1) is mounting for transporting the watercraft on land. The second throughhole 70 also extends from the first surface 58*c* to the third surface 58*e* of the shaft. The second throughhole 70 is configured to receive a pin or fastener for connecting a pontoon or other secondary floatation device to the portage device 10 when the arm 14 is the position shown in FIG. 3 to provide additional support and stability to the watercraft 12.

Figure 14:
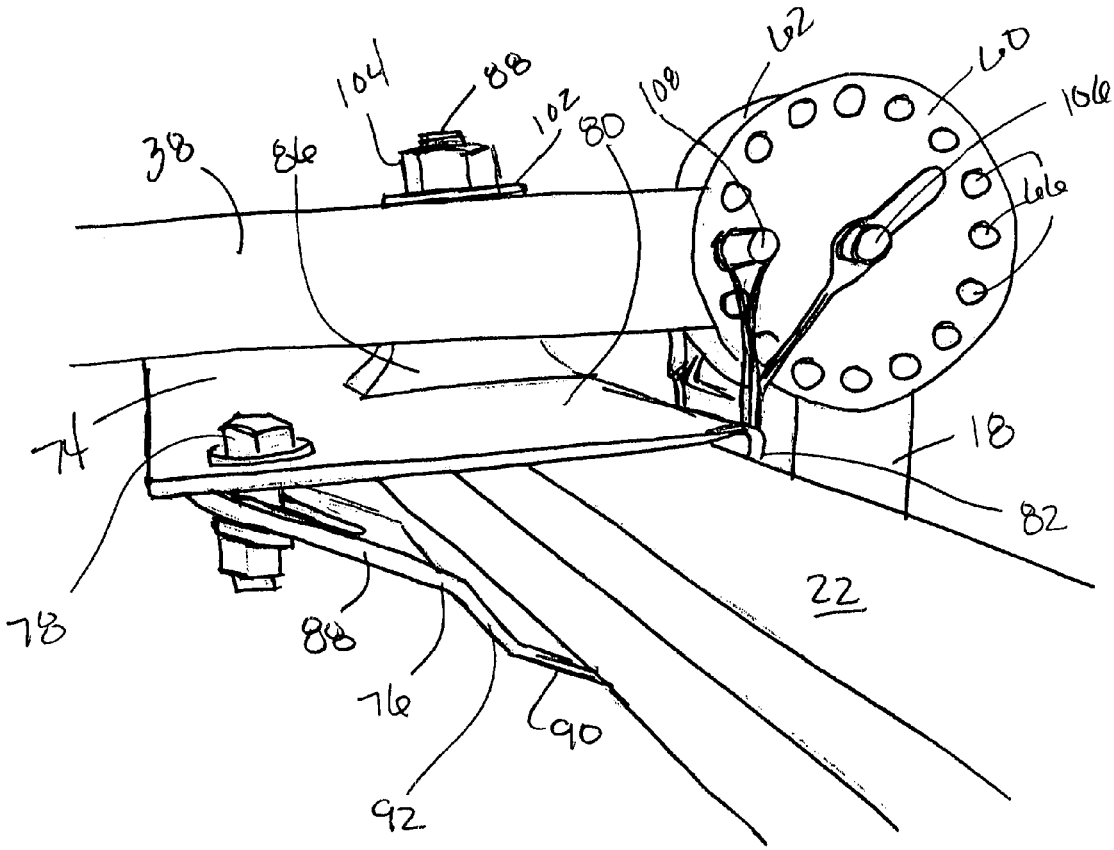
FIG. 14 shows a partial perspective view of an assembly of components of the inventive portage.
Figure 16:
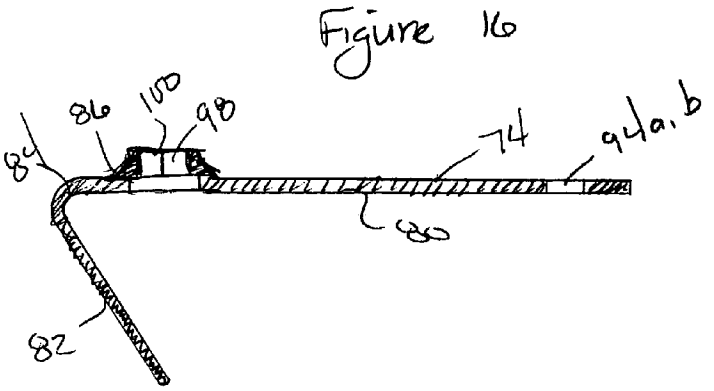
FIG. 16 shows a cutaway side elevation view of a component of the inventive portage device taken along line 16A-16A in FIG. 17.
Figure 15:
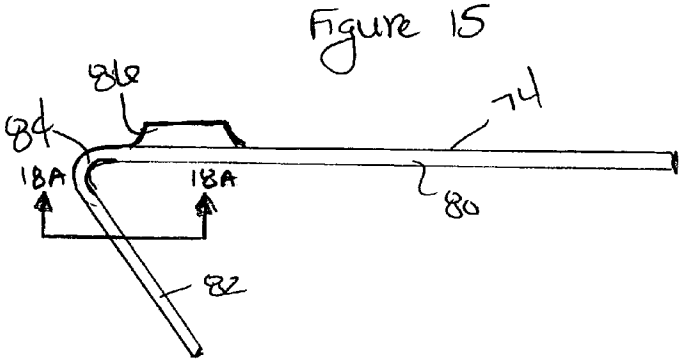
FIG. 15 shows a side elevation view of a component of the inventive portage device.
Figure 18:
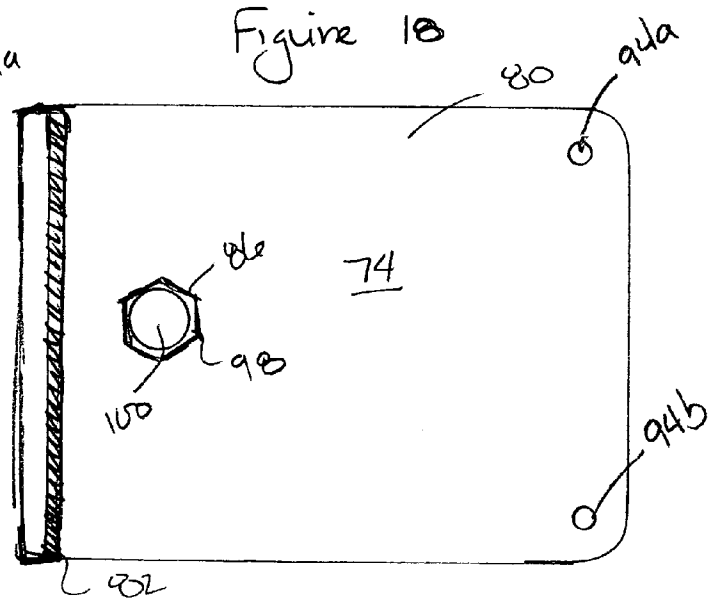
FIG. 18 shows a bottom plan and partial cutaway view taken along line 18A-18A of FIG. 15 of a component of the inventive portage device.
Figure 17:
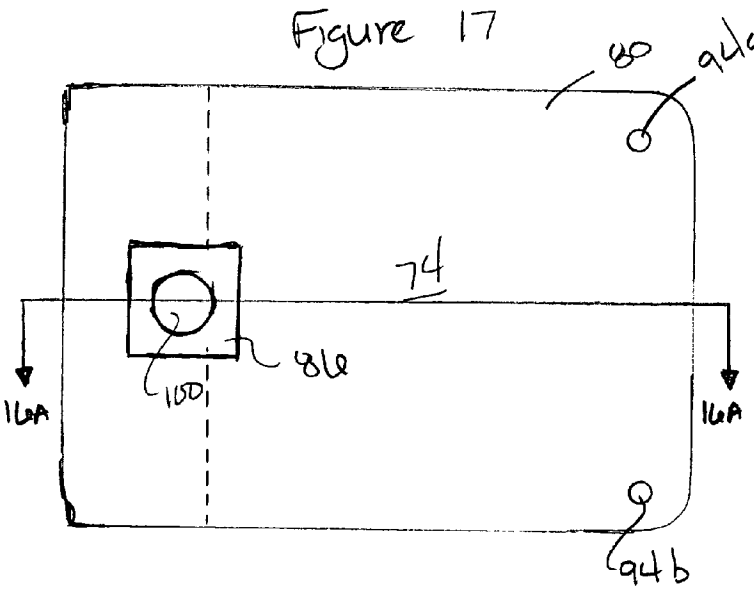
FIG. 17 is top plan view of a component of the inventive portage device.
Figure 20:
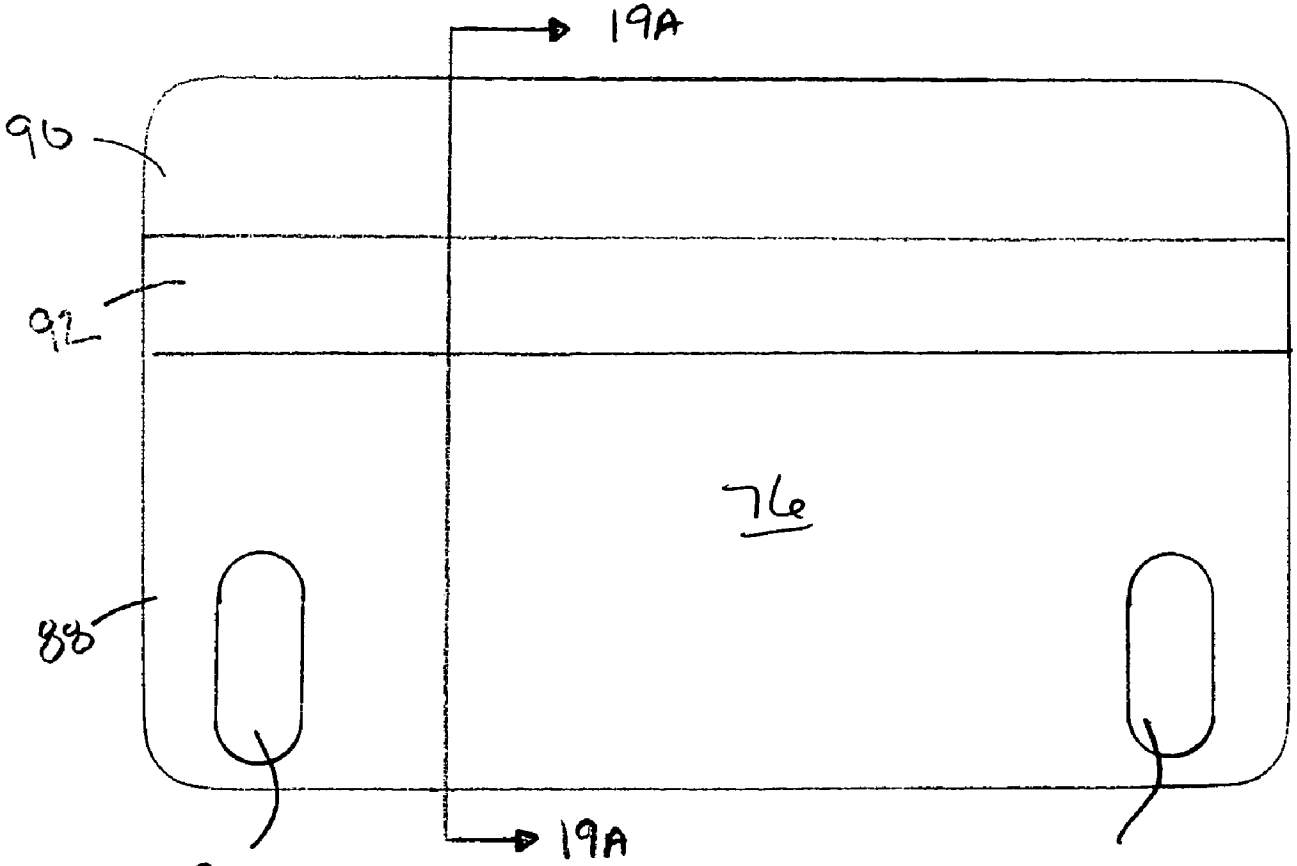
FIG. 20 shows a top plan view of a component of the inventive portage device.
Figure 19:
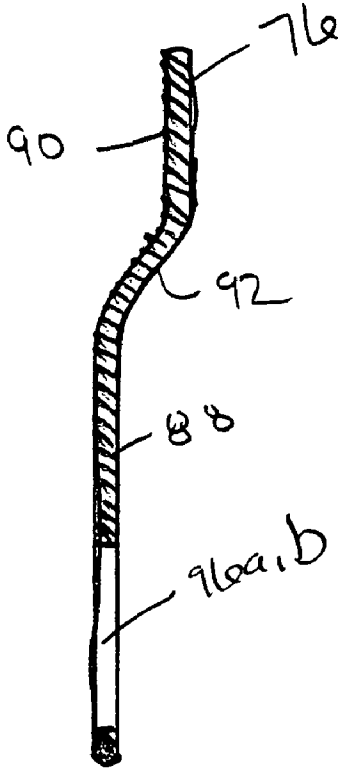
FIG. 19 shows a cutaway side elevation view of a component of the inventive portage device taken along line 19A-19A in FIG. 20.
Figure 21:
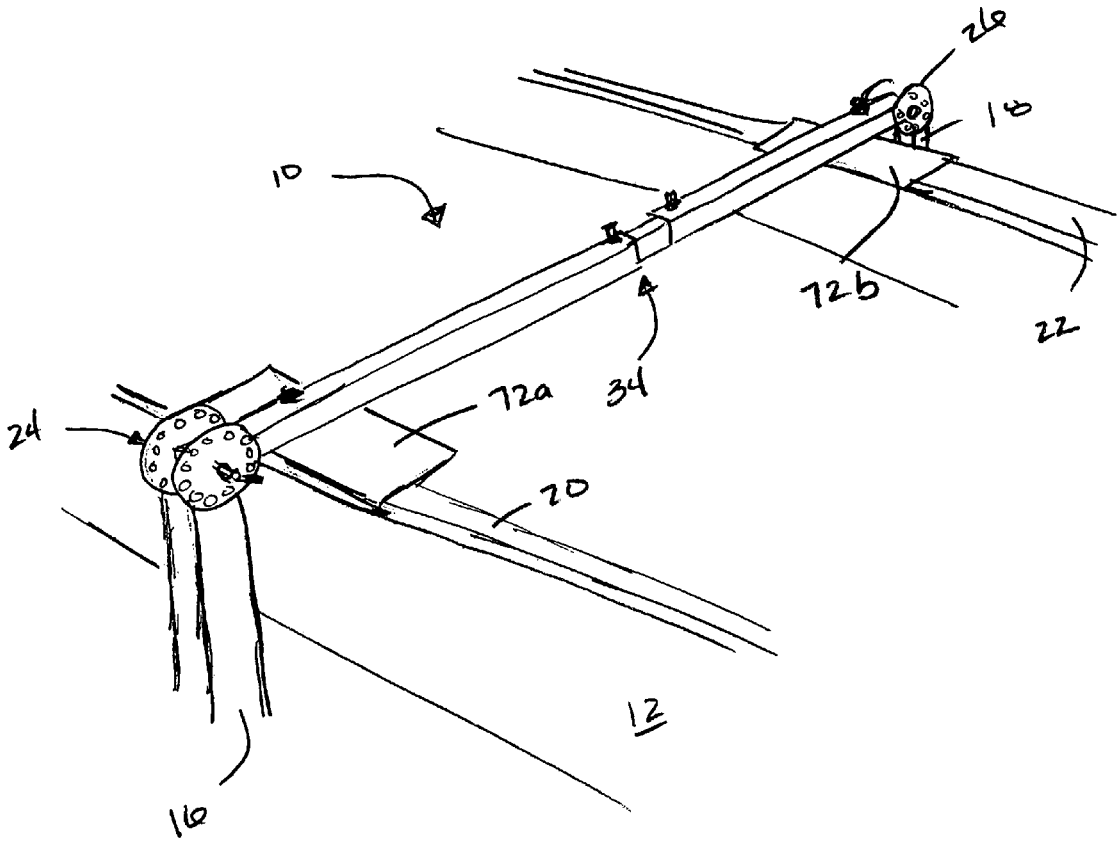
FIG. 21 shows a partial perspective view of the inventive portage device.

Referring now to FIGS. 13-19, the gunwale clamp assembly 72 for mounting the inventive portage device 10 to the watercraft 12 is shown. The gunwale clamp assembly 72 is configured to operatively connect to a variety of watercraft gunwale cross-sections. The gunwale clamp assembly 72 comprises a top plate 74 and inside plate 76 operatively and adjustably coupled together by a fastener 78. The top plate comprises a top section 80, an angled section 82 and an elbow section 86 interconnecting the top section and angled section. As is seen in FIG. 14, the top section 80 rests on the top of the gunwale 22 and the angled section 82 wraps around the outside of the gunwale 22. The inside plate 76 comprises a first and second segment 88, 90 interconnected at an offset by a web portion 92. In a second preferred embodiment, as shown in FIG. 1, the inside plate has a flat or straight profile. As shown in FIG. 14, the second segment 90 engages the underside of the gunwale to secure the gunwale clamp assembly 72 to the gunwale 22.

The top plate 74 and inside plate 76 are coupled together by a fastener 78 that is preferably a threaded screw or pin. The fastener extends through a bore 94*a, b* in the top plate 74 and a slotted aperture 96*a, b* on the inside plate 76. This arrangement provides for adjustment of the extension of the inside plate 76 to engage gunwales of different depths.

The gunwale clamp assembly 72 couples to the gunwale 22 in a manner that limits damage to top surface of the gunwale 22. The housing 86 on the top side of the top plate 80 receives a fastener 88 to couple the gunwale clamp assembly 72 to the receiving arm 38. The interior 98 of the housing 86 is configured to receive the head 88*a* of the fastener. In the preferred embodiment shown in FIGS. 13 and 16, the fastener 88 comprises a threaded fastener such as a screw. The fastener 88 inserts through the interior 98 of the housing 96, through the aperture 100 and then passes through the concentric bores 52*a, b* of the receiving arm 36 (FIG. 8) and the washer 102. As the nut 104 tightens, the top plate 74 will be secured to the receiving arm 36 and the head of the fastener 88*a* is drawn away from the top surface of the gunwale 22.

Referring to FIG. 14, a first and second fastener 106, 108 are used to secure the leg 18 and receiving arm 38 at the locking assembly 26. In the first preferred embodiment, the first and second fastener 106, 108 comprise locking pins. However, it is contemplated that any suitable fastener can be utilized. The locking pins 106, 108 enable easy engagement and disengagement allowing the user of the portage device 10 to easily change configurations.

While the present invention has been described in connection with a specific application, this application is exemplary in nature and is not intended to be limiting on the possible applications of this invention. It will be understood that modifications and variations may be effected without departing from the spirit and scope of the present invention. It will be appreciated that the present disclosure is intended as an exemplification of the invention and is not intended to limit the invention to the specific embodiments illustrated and described. The disclosure is intended to cover, by the appended claims, all such modifications as fall within the scope of the claims.

I claim:

1. A portage device for a watercraft, the watercraft comprising a first and second sidewall, each sidewall terminating at a gunwale having a top, inside and outside portion, a bottom section, a first width extending from the first to the second sidewall, a longitudinal axis extending through the length of the watercraft and a transverse axis perpendicular to the longitudinal axis and substantially parallel to the first width, the portage device comprising:

an adjustable transverse frame member having a first end extending to and associated with the first sidewall and a second end extending to and associated with the second sidewall;

a first gunwale clamp assembly operatively connected to the first end of the transverse frame member and the first sidewall;

a first locking assembly interconnecting the first end of the transverse frame and a first leg assembly, the first leg assembly selectively rotatable through a range of positions about a locking axis substantially parallel to the longitudinal axis, the range comprising a transport position, a stabilizing position and a stowing position; and a wheel releasably attached to the first leg assembly.

2. The portage device of claim 1 further comprising a second locking assembly interconnecting the second end of the transverse frame and a second leg assembly.

3. The portage device of claim 1 wherein the first locking assembly comprises:

a first bore and a second bore, each disposed on the first end of the transverse frame, each orientated substantially parallel to the locking axis;

a locking disc connected to a first leg and comprising a central bore and a plurality of locking bores disposed around the circumference of the locking disc;

an axle configured to be received by the central bore of the locking disc and the first bore of the transverse frame to align the locking disc and first end of the transverse arm, and a first clip to secure the axle in position; and a pin configured to be received by one of the plurality of locking bores to selectively align and secure the first leg with the first end of the transverse frame, and a second clip to secure the pin in position.

4. The portage device of claim 3 wherein the axle and first clip combination and pin and second clip combination comprise a first and second cotter pin.

5. The portage device of claim 1 wherein the first gunwale clamp assembly comprises:

a top plate extending over and around the top and outside segments of the gunwale;

an inside plate for engaging the inside of the gunwale;

a bore on the top plate aligned with a slot on the inside plate, the bore and slot configured to receive a fastener to secure the top plate and inside plate together and to the gunwale, wherein the slot enables the inside plate to selectively engage the inside portion of the gunwale at a plurality of positions.

6. The portage device of claim 1 wherein the first gunwale clamp comprises a seat member configured to receive a fastener that extends from the seat member away from the top segment of the gunwale and towards the transverse frame, wherein securing the first gunwale clamp to the transverse frame member causes the fastener to be displaced away from the top segment of the gunwale.

7. The portage device of claim 6 wherein the fastener comprises a bolt having a geometrically shaped head and wherein the seat member has a corresponding shape to securely seat the bolt head therein and restrict axial rotation of the fastener.

8. The portage device of claim 1 wherein the first and second ends of the transverse member are selectively engageable with opposing ends of a connecting member to selectively adjust the length of the transverse member.

9. The portage device of claim 8 wherein a first and second fastener secure the first end and second end of the transverse member to the connecting member.

10. The portage device of claim 8 wherein the first and second fasteners comprise set screws.

11. A portage device for a watercraft, the watercraft comprising a first and second sidewall, each sidewall terminating at a gunwale having a top, inside and outside portion, a bottom section, a first width extending from the first to the second sidewall, a longitudinal axis extending through the length of the watercraft and a transverse axis perpendicular to the longitudinal axis and substantially parallel to the first width, wherein the portage device comprises a first and second leg assembly, each leg assembly selectively rotatable about a locking axis that is substantially parallel to the longitudinal axis and substantially perpendicular to the transverse axis and adiustable through a range of positions comprising a first transport position, a plurality of intermediate, watercraft stabilizing positions, a second transport position, and a stowing position, the portage device further comprising a transverse frame member releasably connected to the watercraft and having a first end and a second end and a first locking assembly enabling the rotation and selective locking of the first leg assembly, wherein the first leg assembly comprises a leg and a locking disk, and the first locking assembly comprises a first bore and a second bore, each disposed on the first end of the transverse frame, each orientated substantially parallel to the locking axis; the locking disc comprising a plurality of locking bores disposed around the circumference of the locking disc and a central bore; an axle configured to be received by the central bore of the locking disc and the first bore of the transverse frame member to align the locking disc and first end of the transverse frame member, and a first clip to secure the axle in position; and a pin configured to be received by one of the plurality of locking bores to selectively align and secure the first leg assembly with the first end of the transverse frame member, and a second clip to secure the pin in position.

12. The portage device of claim 11 further comprising a second locking assembly interconnecting the second end of the transverse frame and the second leg assembly.

13. The portage device of claim 11 wherein the axle and first clip combination and pin and second clip combination comprise a first and second cotter pin.

14. The portage device of claim 11 wherein the first gunwale clamp assembly comprises:

a top plate extending over and around the top and outside segments of the gunwale;

an inside plate for engaging the inside of the gunwale;

a bore on the top plate aligned with a slot on the inside plate, the bore and slot configured to receive a fastener to secure the top plate and inside plate together and to the gunwale, wherein the slot enables the inside plate to selectively engage the inside portion of the gunwale at a plurality of positions.

15. The portage device of claim 11 wherein the first gunwale clamp comprises a seat member configured to receive a fastener that extends from the seat member away from the top segment of the gunwale and towards the transverse frame, wherein securing the first gunwale clamp to the transverse frame member causes the fastener to be displaced away from the top segment of the gunwale.

16. The portage device of claim 15 wherein the fastener comprises a bolt having a geometrically shaped head and wherein the seat member has a corresponding shape to securely seat the bolt head therein and restrict axial rotation of the fastener.

17. The portage device of claim 11 wherein the first and second ends of the transverse member are selectively engageable with opposing ends of a connecting member to selectively adjust the length of the transverse member.

18. The portage device of claim 17 wherein a first and second fastener secure the first end and second end of the transverse member to the connecting member.

19. The portage device of claim 17 wherein the first and second fasteners comprise set screws.

* * * * *